US006302811B1

(12) United States Patent
Topham

(10) Patent No.: US 6,302,811 B1
(45) Date of Patent: Oct. 16, 2001

(54) HEIGHT ADJUSTABLE BASKETBALL SYSTEM

(76) Inventor: Michael Topham, 7578 Misty Hollow, West Jordan, UT (US) 84084

( * ) Notice: Subject to any disclaimer, the term of this patent is extended or adjusted under 35 U.S.C. 154(b) by 0 days.

(21) Appl. No.: 09/440,377

(22) Filed: Nov. 15, 1999

(51) Int. Cl.[7] ..... A63B 63/08

(52) U.S. Cl. ..... 473/484; 473/483; 248/280.11; 248/281.11

(58) Field of Search ..... 473/483, 484, 473/482, 481; 248/283.1, 280.11, 292.1, 281.11, 284.1

(56) References Cited

U.S. PATENT DOCUMENTS 5,211,393 * 5/1993 Rolffs et al. .
6,077,177 * 6/2000 Winter et al. .
6,120,396 * 9/2000 Van Nimwegen et al. .

* cited by examiner

*Primary Examiner*—William M. Pierce
(74) *Attorney, Agent, or Firm*—Holme Roberts & Owen LLP

(57) ABSTRACT

A height adjustable basketball goal system has a backboard with a hoop attached. A hollow vertical support member has brackets proximate its upper end. An upper and a lower support each having a pair of support arms attached at one end to the backboard and at the other ends to the brackets in a prism-like shape. A fulcrum is attached to the vertical support, and a lever arm is attached at one end to one of the upper and lower supports. A linear actuator is disposed within the hollow vertical support member and is pivotally linked to the lever arm. The linear actuator moves the end of the lever arm and in doing so deforms the parallelogram structure to effect arcuate movement of the backboard and hoop thus changing the height of the backboard and hoop relative to a playing surface. The linear actuator is connected to a rack and pinion or jack screw operable by the user to urge the linear actuator and in turn the lever arm to move the backboard.

25 Claims, 7 Drawing Sheets

HEIGHT ADJUSTABLE BASKETBALL SYSTEM

BACKGROUND OF THE INVENTION

1. Field of the Invention

The present invention relates generally to a system for adjusting the height of a basketball goal. More particularly, the invention pertains to an adjustable height basketball system having an operating mechanism within the upright and with a leveraging system to move the backboard.

2. State of the Art

Regulation height for a basketball hoop or rim is ten (10) feet. For various reasons, one may wish to vary the height of a basketball hoop or rim to more than or less than the regulation height. For example, young children may have difficulty in shooting the basketball into a goal set at regulation height. Therefore, it may be desired to lower the goal to encourage young children to learn and play basketball.

While many adjustable height systems are available, there are various disadvantages associated with each of them. Many are cumbersome and awkward to operate, some require the use of a ladder or special tools for proper adjustment, some are arranged in a manner that exposes players and operators of the mechanism to potential dangers of varying degrees, and nearly all are arranged so as to expose the adjustment actuator to weathering of the elements with the potential for inducing maintenance problems.

U.S. Pat. No. 5,211,393 (Rolffs, et al.) shows one adjustable system in which a backboard is pivotally mounted to a mast section that is offset from a ground supported mast. A jack extends upwardly out of the mast to contact the backboard support structure. The system requires a jack system that supports a substantial portion of the weight of the backboard and the rim/hoop structure as well as any pressure from a player that may choose to jump and grasp or hang onto or from the rim. Thus, the jack system must be able to withstand these forces leading to expensive design requirements.

U.S. Pat. No. 5,695,417 (Winter, et al.) shows an adjustable system in which the backboard supports are attached to the mast or post to rotate on an axle and also extend past the upright mast or post for connection to a mechanism that extends externally along the outside of the mast or post. The arms or separate support elements of the backboard support act as levers so that the distal ends and in turn the operating mechanism move in an arc with the leverage arm extending away from the upright post. In turn the leverage mechanism is exposed to the elements when used out of doors and in turn is susceptible to deterioration from rust and dirt. In both indoor and outdoor use, the mechanism is otherwise exposed to contact by basketballs with the risk of suffering damage from or causing damage to the basketballs. Further, some users may wrap the mast or post with a cushioning material to protect players from injury should they be unable to avoid running into the post or mast. The cushioning material inhibits or reduces the ease of use of the height adjusting system and may also get caught in or otherwise interfere with proper operation.

Some mechanisms to adjust the height involve latches and notches along with sticks or poles that must be used to push the backboard structure to a desired height. See for example, U.S. Pat. No. 5,324,027 (Nye); U.S. Pat. No. 4,781,375 (Nye) and U.S. Pat. No. 4,881,734 (Nye). Some mechanisms not only are height adjustable but are incorporated into a portable or moveable base. See: U.S. Pat. No. 5,375,835 (VanNimwegen, et al.).

SUMMARY OF THE INVENTION

A basketball goal or standard has a mechanism for adjusting the height of the backboard or rim/hoop. The mechanism is internally disposed within the vertical support member of the basketball goal to be protectable from the elements and to limit exposure to damage to persons, players and basketballs.

The adjustable basketball goal system of the invention includes a vertical support member having an upper end and a lower end. The vertical support member has a hollow portion and an aperture formed therein proximate its upper end. A first support structure has a first end pivotally attached to the vertical support member and preferably to a bracket mounted proximate the upper end of the vertical support member. A second support structure also has a first end pivotally attached to the vertical support member. Preferably it is mounted to a bracket that is attached to the vertical support member spaced from the first end of the first support structure.

A backboard has a front and a back. The second end of the first support structure and the second end of the second support structure are each rotatably attached to the back. A basketball hoop or rim is mounted to the front of the backboard.

A fulcrum is attached proximate the upper end of the vertical support member preferably between the upper and lower brackets. A lever member has a first end and a second end with a fulcrum point in between positioned proximate the fulcrum. The first end of the lever is rotatably attached to one of the first support structure and the second support structure and preferably to a cross member that extends between spaced apart arms of either one and preferably the second or lower of the first and second support structures. The lever member has a first lever portion extending from the first end to the fulcrum point and a second lever portion extending from the second end to the fulcrum point. The second lever portion extends into the vertical support member.

An actuator is positioned within the hollow portion of the vertical support member. The actuator has an upper end connected to the second lever portion to move the second portion of the lever member about the fulcrum and in turn cause the first portion of the lever member to urge the backboard to move between a first position and a second position vertically displaced from the first position. The lower end of the actuator is attached to an operating structure connected to the vertical support member and positioned for operation by a user. The operating structure is configured for operation by the user such as by a crank. In preferred and alternate arrangements, the operating structure may be a screw jack.

In a preferred arrangement, the backboard extends away from the vertical support member toward the playing surface while the crank member of the operation structure is oriented to extend away from the playing surface. Of course, the crank member is also removable. Mechanical stops may be provided to regulate or control the travel distance of the lever member as it rotates about the fulcrum. A vertical height or location indicator may also be included. The vertical support member may be connected or installed in the ground or may be mounted to a moveable base.

In a preferred configuration, the upper bracket and the lower bracket each have an axle. The first and second support structures are preferably formed to be substantially triangular in projection with an apex rotatably connected to the axles of upper and lower brackets. In a most preferred arrangement, the axle of the lower bracket is the fulcrum.

BRIEF DESCRIPTION OF THE DRAWINGS

In the drawings, which depict presently preferred embodiments of the invention and in which like reference numeral refer to like parts in different views.

DETAILED DESCRIPTION OF THE INVENTION

Figure 1:
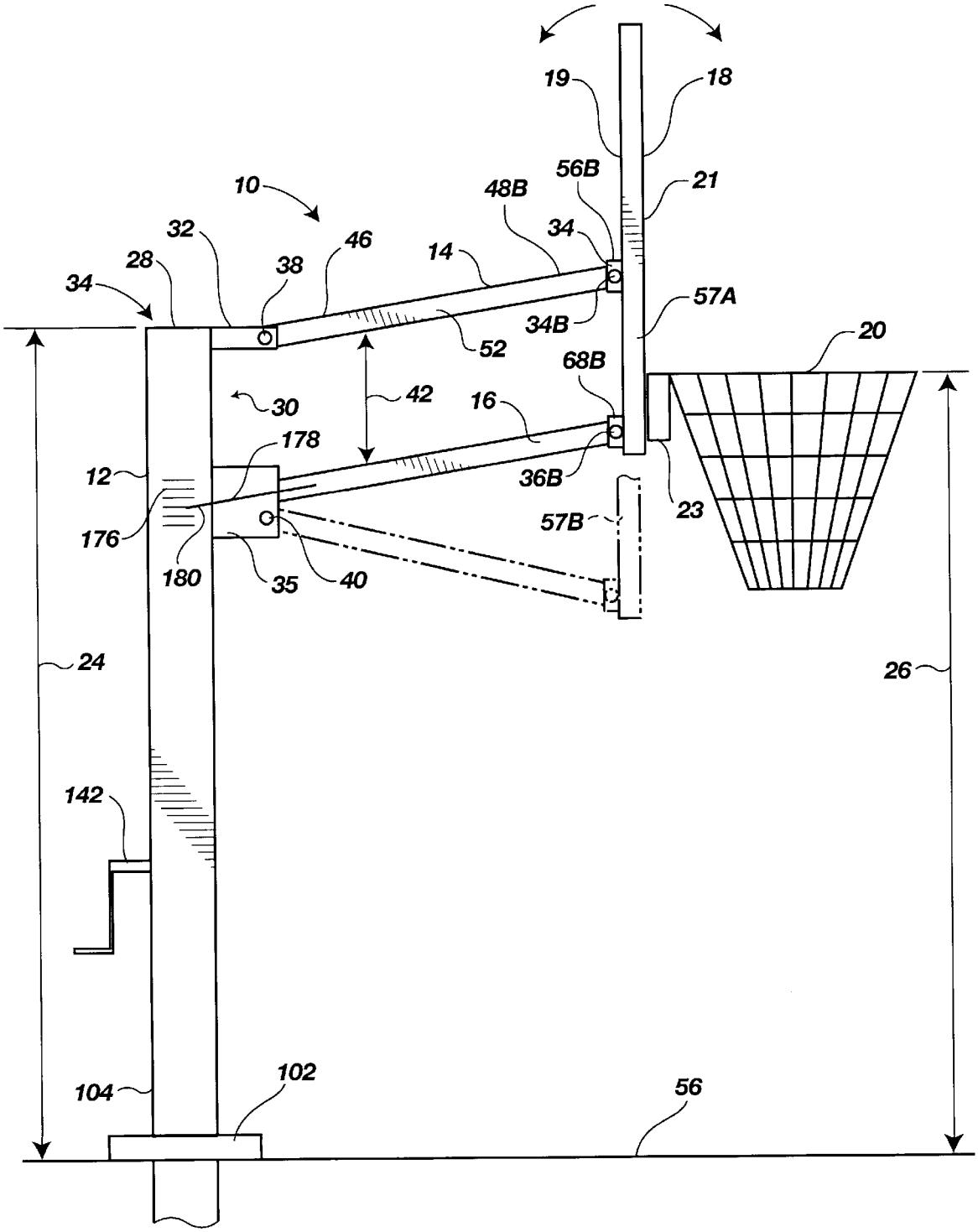
FIG. 1 is a side elevation view of a fixed mount basketball goal system.

Referring to FIG. 1, the basketball goal system 10 includes a vertical support member 12, a first or upper support structure 14, a second or lower support structure 16 and a backboard 18 with a rim or hoop 20 attached to the front 21 by any suitable means. In some arrangements attachment of the hoop 20 is effected by a fixed bracket 23 or by other bracket means which function to allow the rim or hoop 20 to move relative to the backboard 18.

The vertical support member 12 is here shown to be a metal cylinder or tube with a hollow interior 22 and contains mechanisms to vary the vertical position of the backboard 18 as hereinafter discussed. The vertical support member 12 may also be an upright prism which may be of any suitable shape in cross section such as a square or rectangle. The vertical support member 12 functions to provide the desired or necessary height 24 that yields a desired or required height 26 of the hoop or rim 20. It also desirably functions to support the backboard 18 and the other mechanisms illustrated and discussed herein. It also is sized and shaped to withstand the stress, torque or forces arising when at least one person hangs or suspends himself or herself from the rim or hoop 20. That is, a player may grab or hang onto the rim or hoop 20 as part of a "slam dunk" maneuver thereby creating static and dynamic forces that must be withstood or sustained by the vertical support member and all the other mechanisms that support the backboard 18.

The vertical support member 12 preferably has a cap or top 28 welded or otherwise secured in place to preclude water or other foreign matter from entering the vertical support member. That is, snow, ice, water or other liquids may all contribute to corrosion over time; and dirt, dust, grit and other solid materials may become entrained at various lubricated joints or other moving surfaces to inhibit movement over time. The cap or top 28 is suitably attached to inhibit the entry of such materials into the interior 22 of the vertical support member 12. The cap or top 28 may be made to be removable to permit access for lubrication and other maintenance if desired. A simple locking screw or friction fit is presently believed to be sufficient.

As can be seen in FIG. 1, the first or upper support structure 14 and the second or lower support structure 16 are rotatably attached at the upper end 30 of the vertical support member 12. As shown, upper bracket 32 is connected or attached to the vertical support member 12 proximate the upper end 30 by any suitable means such as welding. The use of bolts and screws may also be suitable. Although here shown mounted at the distal end 34, the bracket 32 may be mounted at any convenient location at the upper end 30 of the vertical support member 12. The bracket 32 has an axle 38 to which the upper or first support structure 14 is rotatably attached.

A lower bracket 35 is shown spaced from and below the upper bracket 32 a suitable distance to provide for the spacing 42 between the upper or first support structure 14 and the second or lower support structure 16 needed to provide suitable vertical support for the backboard 18. That is, suitable spacing 42 (e.g., two feet) strengthens the mechanical system to sustain or withstand various forces or torques 44 which may be applied from time to time, such as by the slam dunk maneuver. The lower bracket 35 has an axle 40 to which the second or lower support structure 16 is rotatably attached.

Figure 2:
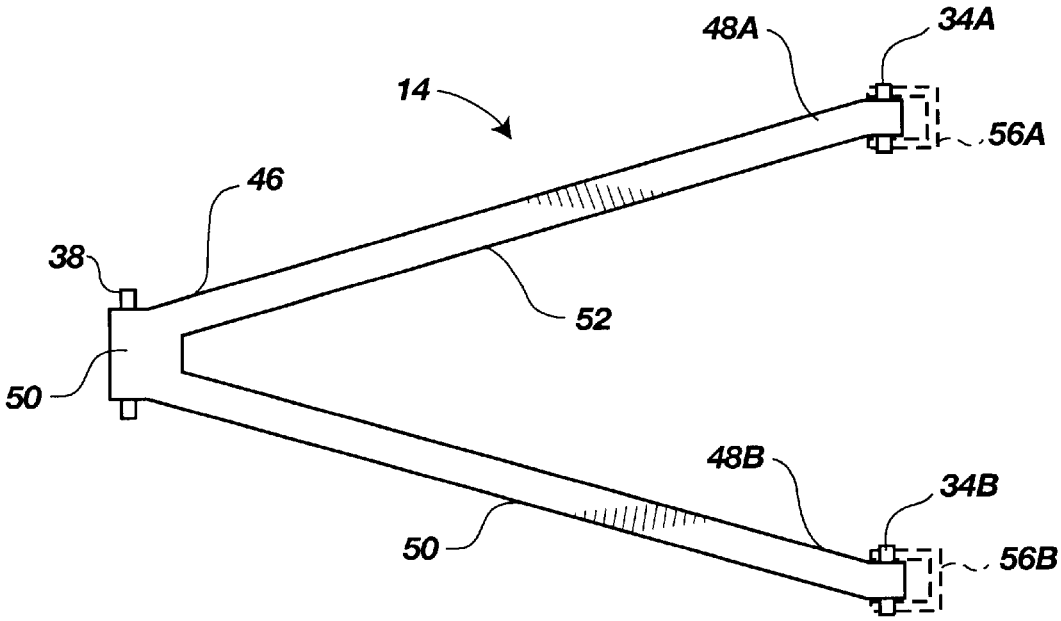
FIG. 2 is a top view of the upper support arm.

FIG. 2 shows the first or upper support structure 14 having a first end 46 pivotally or rotatably mounted to the vertical support structure 12. The first or upper support structure also has a second end which is here shown to be the second ends 48A and 48 B pivotally or rotatably attached to the backboard 18. In the preferred arrangement of FIG. 2, a left arm 50 and a right arm 52 are spaced apart and generally configured to be triangular in projection with an apex 54 mounted to the axle 38. Notably, the apex 54 may be mounted to rotate about the axle 38 or to rotate with the axle 38 as desired.

The second ends 48A and 48B each are mounted to a pair of spaced apart (e.g., two feet) brackets 56A and 56B to rotate about or with axles 34A and 34B. The brackets 56A and 56B are attached to the back 19 of backboard 18 by screws (not shown) or any other means for suitable attachment that withstands the torques or forces that arise in use.

Figure 3:
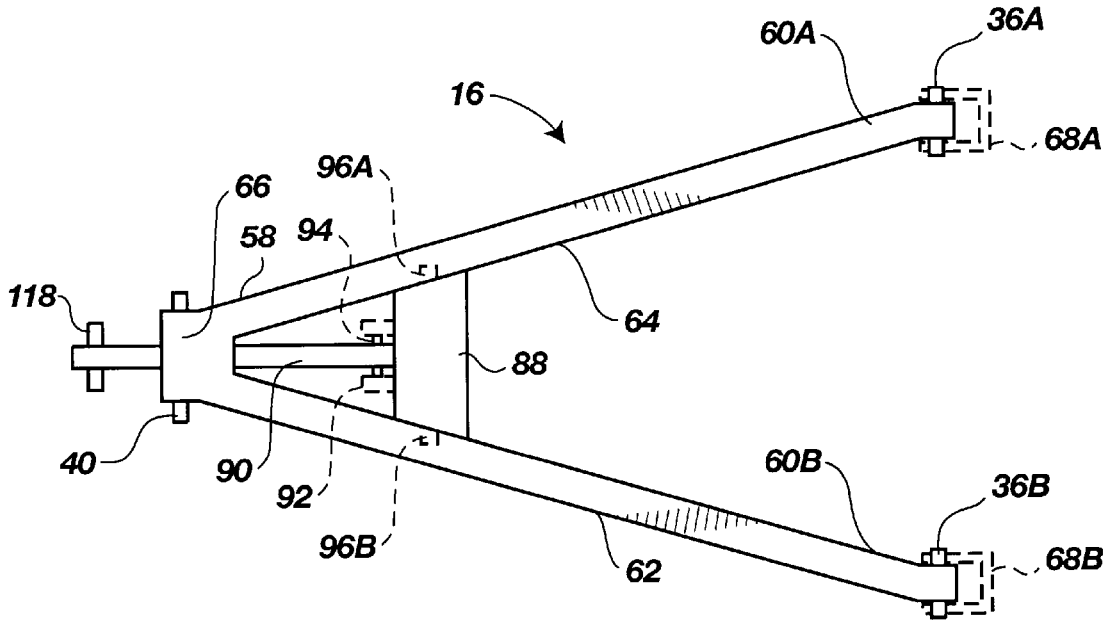
FIG. 3 is a top view of the lower support arm.

The second or lower support structure 16 is shown in FIG. 3 having a first end 58 pivotally or rotatably attached to the vertical support member 12 . The lower support structure also has a second end which is here shown to be second ends 60A and 60B pivotally or rotatably attached to the backboard 18. Here, too, the support structure 16 has a left arm 62 and a right arm 64 which are spaced apart and generally configured to be triangular in projection with an apex 66 mounted to rotate about the axle 40 or with the axle 40 as desired. Similarly the second ends 60A and 60B are each mounted to a pair of spaced apart (e.g., two feet) brackets 68A and 68B to rotate about or with axles 36A and 36B respectively. The brackets 68A and 68B are secured to the back 19 of backboard 18 by screws (not shown) or other suitable means to maintain a secure connection and to withstand the forces that arise in use.

In reference to FIGS. 2 and 3, it can be seen that the upper support structure 14 and the lower support structure 16 with the backboard 18 form what is essentially a prism that deforms to allow for vertical movement of the backboard 18 and rim or hoop 20. While the motion of the backboard 18 is arcuate in nature with a center of rotation being the axles 38 and 40, the pivotal connections of axles 34A, 34B, 36A, 36B, 38, and 40 allows the backboard 18 and rim or hoop 20 to maintain the same normal or perpendicular relationship with the playing surface 56 as it moves between a first position 57A as shown in solid in FIG. 1 and a second position 57B shown only partially and then in phantom in FIG. 1. In a practical system, the basketball goal system 10 is assembled so that the rim or hoop 20 has a substantially parallel relationship with the playing surface 56 and the backboard 18 has a substantially perpendicular relationship between the playing surface 56.

Figure 4:
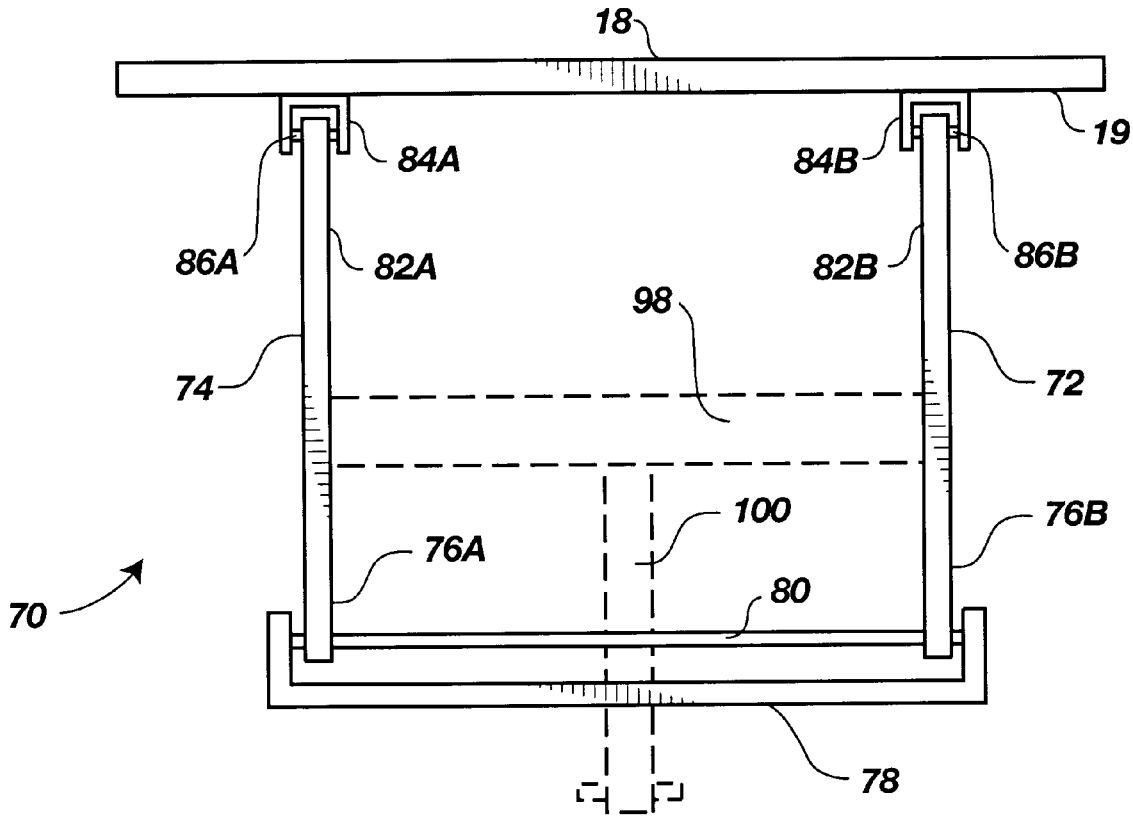
FIG. 4 is as top view of an alternate support arm arrangement.

FIG. 4 shows an alternate upper support structure 70 having a left arm 72 and a right arm 74 spaced apart and substantially parallel. The first ends 76A and 76B are rotatably or pivotally mounted to the vertical support member 12 and more specifically to bracket 78 to rotate with or about axle 80. The second ends 82A and 82B are rotatably or pivotally mounted to the back 19 of backboard 19 and more specifically to brackets 84A and 84B to rotate or pivot with or about axles 86A and 86B.

In FIG. 3, a cross member 88 is shown extending between the arms 64 and 62 as a strengthener or stiffener. A lever member 90 is shown fixedly attached to the cross member 88. However as shown in phantom in FIG. 3, the lever member 90 may be pivotally or rotatably mounted to the cross member 88 by a bracket 92 and pivot pin 94. Alternately, the cross member 88 could be attached to the arms 62 and 64 to rotate about the axles 96A and 96B.

In FIG. 4, a cross member 98 and a lever member 100 are shown in phantom because they may be connected to the first or upper support structure 14 as well as to lower support structure 16.

Referring back to FIG. 1, a mounting plate 102 is shown associated such as by welding with the lower end 104 of the vertical support member 12. The mounting plate 102 may have holes bored through (not shown) so that the vertical support member 12 may be fastened to a playing surface 56 with appropriate bolts. Alternately, the mounting plate 102 is a collar; and the vertical support member 12 extends therethrough for securement in, for example, cement. Of course any other suitable method can be used to mount the vertical support member 12 at or near the playing surface 56.

Figure 5:
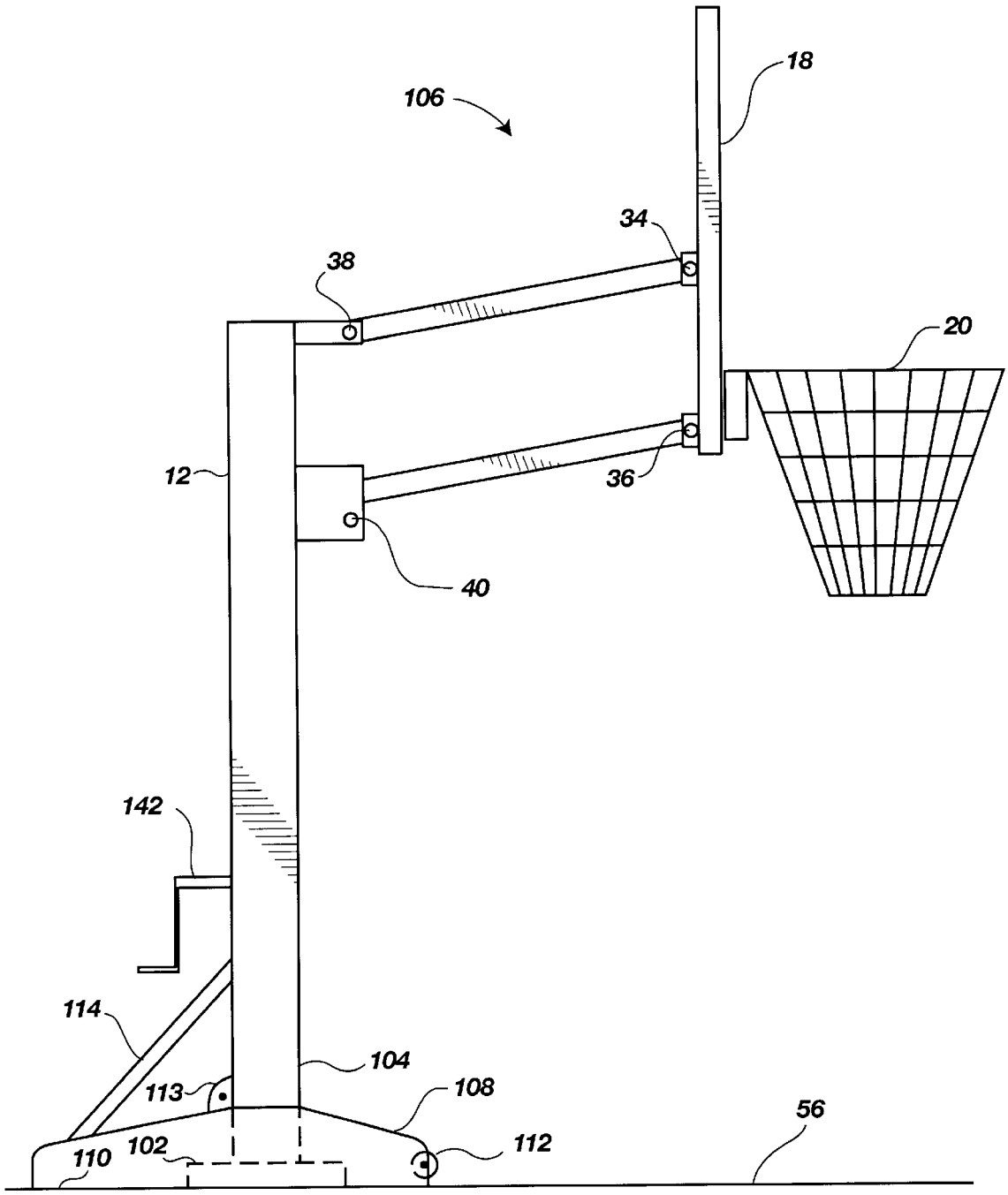
FIG. 5 is a side elevation view of a moveable basketball goal system.

Referring to FIG. 5, a portable or moveable form 106 of the basketball goal system 10 is shown. The vertical support member 12 is shown extending into base 108 with the mounting plate 102 welded to the lower end 104 of the vertical support member 12 and shown in phantom inside the base 108 so that the vertical support member 12 may be bolted or otherwise secured to the base 108 and more specifically to the bottom 110 of the base 108. As so configured, the basketball goal system 10 may be moved from one area on or proximate the playing surface 56 to another by tipping it onto wheels 112. This is an advantage sometimes sought by those who desire a basketball goal system 10 but have limited space to dedicate as a playing surface 56. Alternately, the goal system 10 may not have a mounting plate 102. Rather, the vertical support member 12 is attached to the base 108 by a hinge 113 and is stabilized with a support 114 that may be removed to allow the vertical support member to be tipped over to be more in alignment with the base 108 and to facilitate storage, such as in a garage associated with a home.

Figure 6:
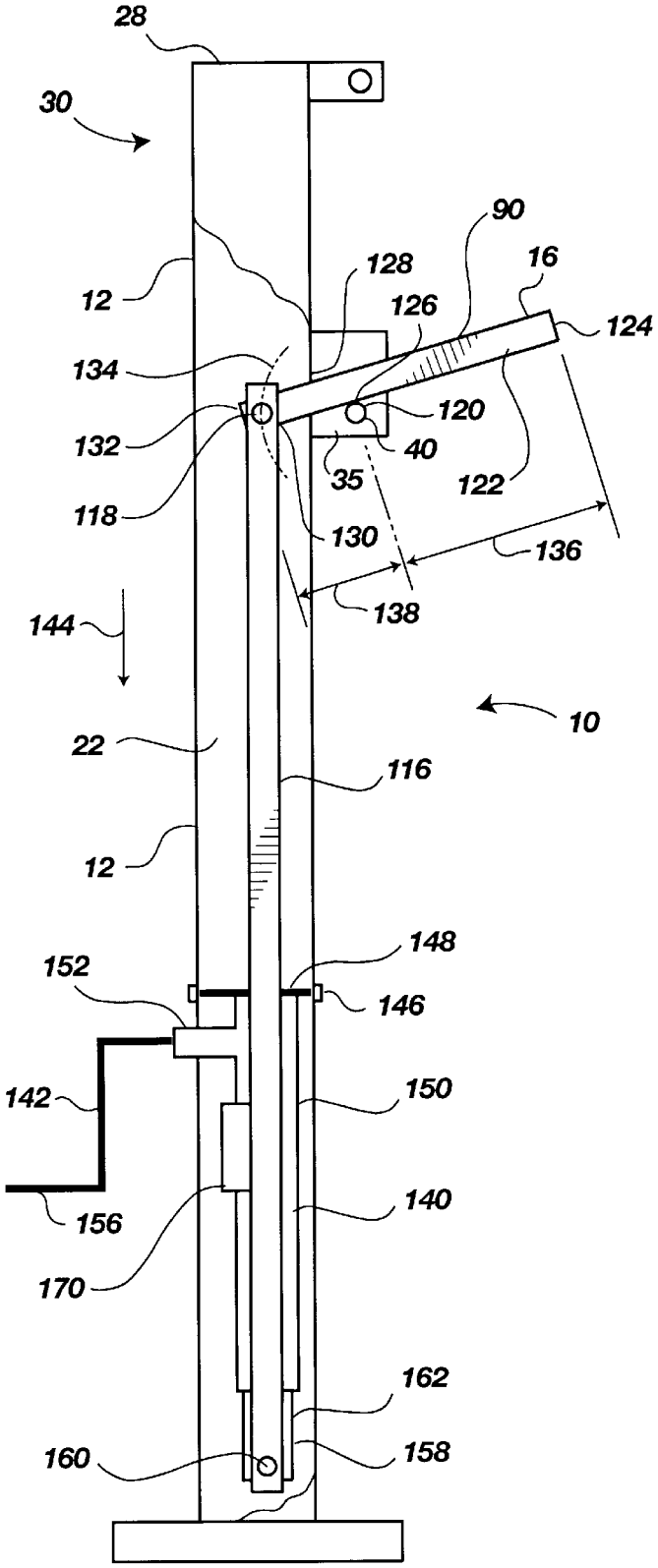
FIG. 6 is a fragmentary side elevation view of the hollow support member showing the internal components therein.

Referring now to FIG. 6, the basketball goal system 10 of FIG. 1 is shown in cut-a-way. As noted, the vertical support member 12 also has a hollow interior 22. A linear actuator 116 is disposed within the hollow interior 22 to extend from an operating structure such as jack screw 140 to the lever member 90. The linear actuator 116 is pivotally or rotatably connected to the lever member 90 by a lever pin 118. Upon upward and downward movement of the linear actuator 116, the lever member 90 rotates about fulcrum 120. The lever member 90 has a first lever portion 122 that extends from the first end 124 to the fulcrum point 126. The lever member 90 extends through the aperture 128 formed in the vertical support member 12 with a second lever portion 130 extending from the fulcrum point 126 to the second end 132. As the linear actuator 116 moves, it urges the lever pin 118 through an arc 134. The aperture 128 is sized to allow full movement of the lever member 90 and more specifically the second lever portion 130.

Notably, the first lever portion 122 has a length 136 which is longer than the length 138 of the second lever portion 130. The lengths 136 and 138 are selected based on the weight of the backboard 18 and hoop 20 along with the first support structure 14 and second support structure 16 to provide the necessary leverage.

Operating structure such as a jack screw 140 is provided to convert rotational torque supplied by the user via crank 142 to linear force to be applied at the lever pin 118. Although a jack screw is preferred, other suitable actuators such as a rack and pinion set, hydraulic or pneumatic pistons, a chain and gear set, or the like may be used so long as it can provide sufficient force. That is, the second lever portion 130 is shorter than the first lever portion 122 thereby creating a negative mechanical advantage. In turn, the downward force 144 must be sufficient given the negative mechanical advantage to lift the backboard 18 and hoop 20 from its lowest position to its highest position.

The jack screw 140 converts the rotational torque to linear motion at a force sufficient to move the backboard 18 between the first position and the second position. Of course, it should be apparent that gravity assists in moving the backboard 18 from an elevated position to a lower position.

Figure 7:
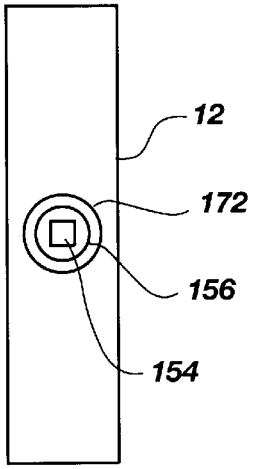
FIG. 7 is a partial view of a portion of the vertical support member.

The jack screw 140 is mounted within the vertical support member 12 by a mounting bolt 146 which passes through the vertical support member 12, through a mounting bracket 148 at the upper end 150 of the jack screw 140. A crank stem 152 extends from the jack screw 140 through the vertical support member 12. A removable crank 142 may have a portion that is polygonal and even rectilinear in cross section so that it can mechanically engage the socket 154 shown in FIG. 7. The user can then grasp the handle portion 156 of the crank 142 and rotate it so that the linear actuator 116 may move in the desired direction and in turn the backboard 18 may be adjusted in height. While the activation of the linear actuator 116 in the presently preferred invention is shown as being a mechanical system using a manual force generator, other devices can be used to generate the force including an electrical motor, a hydraulic or pneumatic piston. The linear actuator 116 has an extendable rod member 26 associated with it.

At or near the end 158 of the linear actuator 116 is pivotal connection 160 to which is attached a pair of strut members 164 A and 164 B placed on opposing sides of the jack screw 140. The strut members 164 A and 164 B are substantially parallel with each other. The second lever portion 130 extends into the interior 22 of vertical support member 12. Although another fulcrum may be used, the axle 40 of the lower bracket 35 becomes the fulcrum 120 for the lever member 90.

Figure 8:
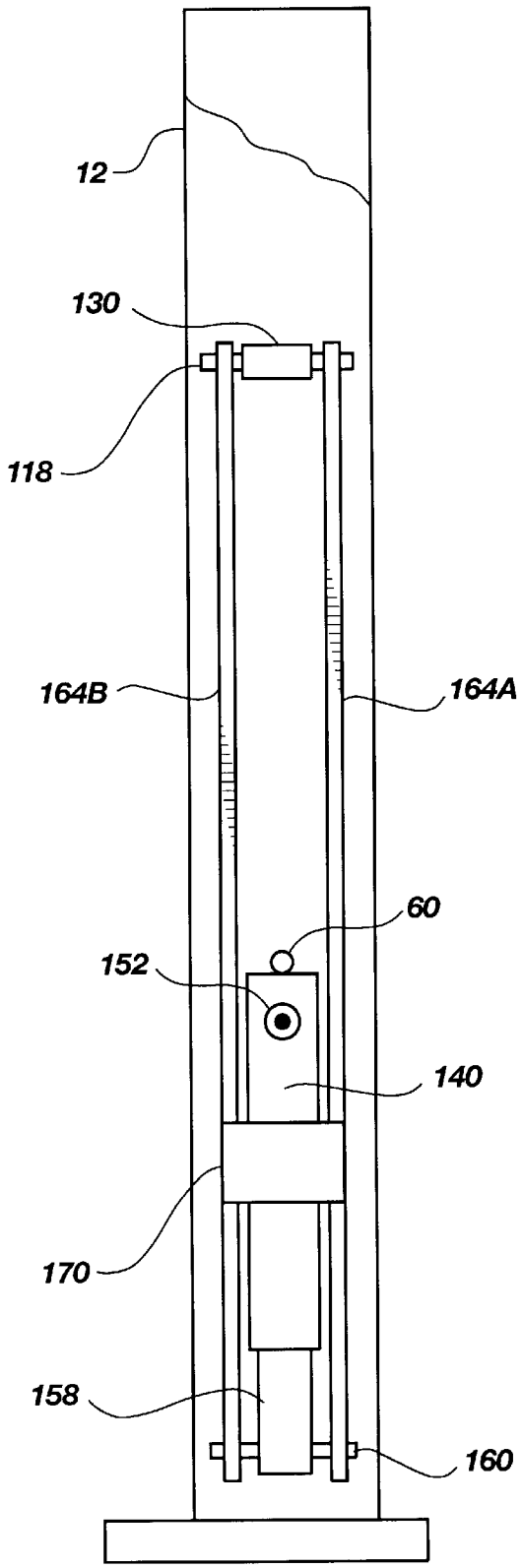
FIG. 8 is a fragmentary back elevation view of the hollow support member showing the internal components therein.

Still referring to FIGS. 6 and 8, a mechanical stop 170 is fixedly attached to strut members 164A and 164B. The mechanical stop 170 is located on the same side of the linear actuator 116 as the crank stem 152. The mechanical stop 170 serves to limit the upward travel of the strut members 164A and 164B and stop the strut members 164A and 164B at a predetermined position to thereby limit the travel of the backboard 18. The upward travel of strut members 164A and 164B is stopped when the mechanical stop 170 comes in contact with the crank stem 152. If desired, the operating structure and specifically the jack screw 140 can be positioned so that the mounting plate 102 acts to limit the downward travel of the strut members 164A and 164B. Alternatively, a second physical stop may be positioned near the upper end 30 of the vertical support member 12 to limit the movement of the second lever portion 130 of the lever member 90.

To operate the basketball goal system 10 (FIGS. 1 and 6), the handle 156 of crank 142 is rotated to cause the screw jack 140 to rotate. In rotating handle 156, screw jack 140 urges the strut members 164A and 164B to pull downward or push upward on the second portion 130 of the lever member 90 at the lever pin 118 inside the vertical support member 12. The lower support structure 16 operates in a see-saw like fashion rotating about the axle 40 which also acts as a fulcrum thereby causing the backboard 18 and goal 20 to move upward while maintaining their respective perpendicular and parallel relationship to the playing surface 56.

In conjunction with adjusting the height of the basketball goal system, it becomes desirable to know the height 26 of the goal 20 above the playing surface 56. As seen in FIG. 1, indicia in the form of a calibrated scale 176 is affixed to one side of the vertical support member 12. The scale 176 is a visible set of marks representing a corresponding height 26. An indicator 178 has one end fixedly attached to the lower support arm 16 while the other end extends toward the scale 176. As the height of the backboard 18 is changed or adjusted, the indicator 178 rotates with the second support structure 16 about the pivotal connection 40. The indicator 178 is formed to extend to a free end 180 positioned near the scale 176. As the second support structure 16 moves, the free end 180 of the indicator 178 will move and point to a specific mark on the scale 176 corresponding to the height 26 of the hoop 20 above the playing surface 56.

In the presently preferred embodiment, the vertical support member 12 is shown essentially perpendicular with the playing surface 56. In some applications, the vertical support member 12 may not be straight with the strut members 164 A and 164 B which are made to be transversely flexible.

Also, it is noted that the upper support structure 14 and lower support structure 16 may be of various sizes and shapes. While the shape of the presently preferred embodiment is that of an "A" or a "V" type frame in planar projection, various other shapes or designs may be utilized. In some cases, a combination of shapes or designs may be used, one shape for the upper support structure 14 and another shape for the lower support structure 16. Each support structure 14 or 16 could also be configured to be one singular arm or a plurality of two or more. It is important, however, that regardless of the shapes utilized, support arms 14 and 16 should provide adequate structural support for the backboard 18 and hoop 20 while allowing the formation of a deformable prism-type structure.

It is also within contemplation that the lever member 90 may be connected to the upper support structure 14 and that the connecting strut members 164A and 164B may be extended to reach the second portion 130. In such a configuration, the bracket 32 must be displaced from the top of the vertical support structure 12 a distance sufficient for movement of the second portion of the lever member 90 through its arc of travel similar to arc 134.

Figure 9:
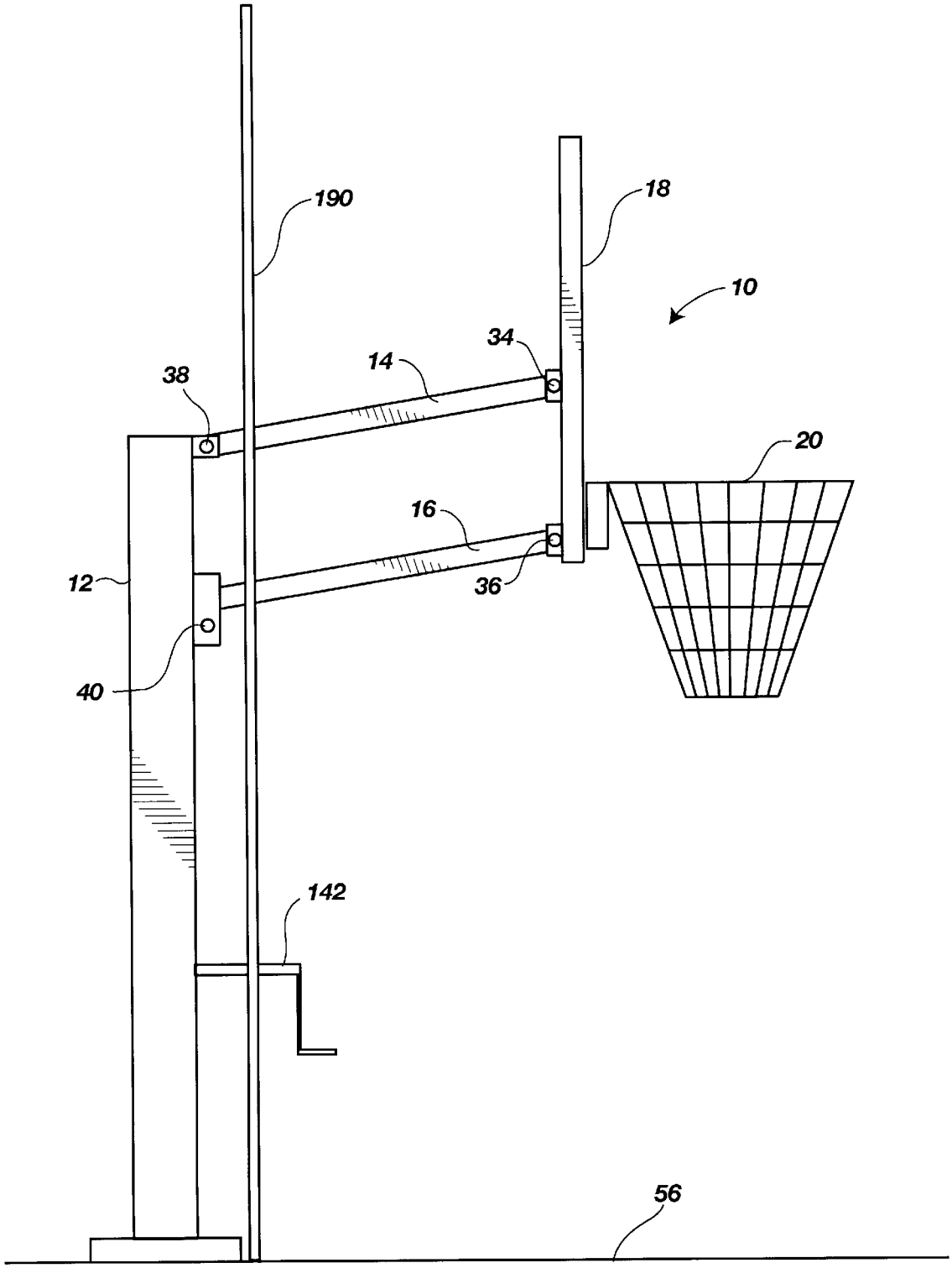
FIG. 9 is an elevation view showing the basketball goal system mounted for play on a tennis court surrounded by a peripheral fence.

It will likewise be appreciated that, through appropriate modifications, the crank 142 may be placed in various strategic locations on the vertical support member 12. One such variation would be to place the crank 142 toward the playing surface 56 (FIG. 9). Indeed, the crank 142 may even extend through a protective fence, crash wall or impact surface 190. Alternately, such a modification would allow the basketball goal system 10 to be placed with the vertical support member 12 closely adjacent a wall or similar structure. However, the preferred location of the crank 142 is oriented away from the playing surface 56 as shown in FIG. 1.

To use the present basketball goal system, the user must first obtain one and cause it to be installed or to be positioned (if portable) in a desired location. A crank 142 is then inserted in the crank socket 154. The user then grasps the handle 156 and rotates the crank 142 in a direction to cause the lever member 90 to rotate about the fulcrum 120 and in turn cause the backboard to adjust in height 26. The crank 142 should then be removed and stored remotely.

Having thus described in detail preferred embodiments of the present invention, it is to be understood that the invention defined by the appended claims is not to be limited by particular details set forth in the above description as many apparent variations thereof are possible without departing from the spirit or scope thereof.

What is claimed is:

1. An adjustable basketball goal system comprising:

a vertical support member having an upper end and a lower end, said vertical support member having a hollow portion and an aperture formed therein proximate said upper end;

a first support structure having a first end and a second end, said first end being pivotally attached to said vertical support member proximate said upper end;

a second support structure having a first end and a second end, said first end being pivotally attached to said vertical support member spaced from said first end of said first support structure;

a backboard having a front and a back, said second end of said first support structure and said second end of said second support structure each being rotatably attached to said back;

a basketball hoop mounted to said front of said backboard;

a fulcrum attached proximate said aperture is formed in upper end of said vertical support member;

a lever member having a first end and a second end with a fulcrum point thereinbetween positioned proximate said fulcrum, said first end being rotatably attached to one of said first support structure and said second support structure, said lever member having a first lever portion extending from said first end to said fulcrum point and a second lever portion extending from said second end to said fulcrum point;

an actuator positioned within said hollow portion of said vertical support member, said actuator having a lower end and an upper end, said upper end being connected to said second lever portion and said actuator being configured to move said second portion of said lever member about said fiilcrum and in turn cause said first portion of said lever member to urge said backboard to move between a first position and a second position vertically displaced from said first position; and an operating structure attached to said vertical support member and positioned for operation by a user, said lower end of said actuator being connected to said operating structure and said operating structure being configured to cause said upper end of said actuator to move said second portion of said lever member upon operation of said operating structure by a user.

2. The basketball goal of claim 1 wherein said first support member has a left arm and a right arm spaced from said left arm.

3. The basketball goal of claim 2 wherein said second support member has a left arm and a right arm spaced from said left arm.

4. The basketball goal of claim 3 further including a cross member extending between said left arm and said right arm of one of said first support member and said second support member, and wherein said first end of said lever member is attached to said cross member.

5. The basketball goal of claim 4 wherein said upper end of said vertical support member is formed with an aperture through which said second portion of said lever member extends.

6. The basketball goal of claim 5 wherein said actuator is connected proximate said second end of said second portion of said lever member within said hollow portion.

7. The basketball goal of claim 6 wherein said operating structure is a jack screw and wherein said actuator is a rigid member.

8. The basketball goal system of claim 7 wherein said operating structure further includes a crank member positioned for grasping and movement by said user an d removably attached to said jack screw.

9. The basketball goal system of claim 8 wherein said backboard is positioned to extend away from said vertical support member toward a playing surface and wherein said crank member is positioned to extend away from said vertical support member and away from said playing surface.

10. The basketball goal system of claim 1 further including at least one mechanical stop positioned to limit movement of said lever member.

11. The basketball goal system of claim 1 further comprising a height scale having an indicator attached to one of said first support member and said vertical support member and indicia positioned on the other of said first support member and said vertical support member and reflective of the vertical positions of said backboard, said indicator being positioned relative to said indicia to indicate a position of said backboard between said first position and said second position.

12. The basketball goal system of claim 1 wherein said lever member is a substantially straight lever.

13. The basketball goal system of claim 1 wherein said vertical support member is fixedly mounted proximate to a playing surface.

14. The basketball goal system of claim 1 further comprising a base member and wherein said lower end of said vertical support member is attached to said base member.

15. The basketball goal system of claim 14 wherein said base member is hollow and formed to receive material as a weight.

16. The basketball goal system of claim 15 wherein said base member has wheels positioned for contact with the playing surface for moving said base member on said playing surface, said wheels being positioned relative to said base member to contact said playing surface upon orientation of said base member relative to said playing surface.

17. The basketball goal system of claim 16 further including an upper bracket attached to said vertical support member to which said first support member is attached.

18. The basketball goal system of claim 17 further including a lower bracket attached to said vertical support member spaced from said upper bracket to which said second support member is attached.

19. The basketball goal system of claim 18 wherein said upper bracket includes an upper axle to which said first support member is rotatably attached and wherein said lower bracket includes a lower axle to which said second support member is rotatably attached.

20. The basketball goal system of claim 19 wherein said fulcrum is positioned between said upper bracket and said lower bracket.

21. The basketball goal system of claim 20 wherein said fulcrum is said lower axle.

22. The basketball goal system of claim 21 wherein said first arm and said second arm of said first support member are formed to be substantially triangular in projection with an apex rotatably connected to said upper axle.

23. The basketball goal system of claim 22 wherein said first arm and said second arm of said second support member are formed to be substantially triangular in projection with an apex rotatably connected to said lower axle.

24. The basketball goal system of claim 23 wherein one of said cross member and said first end of said lever is mounted for rotational movement relative to one of said first support member and said second support member.

25. An adjustable basketball goal system comprising:

a vertical support member having an upper end and a lower end, said vertical support member having a hollow portion and an aperture formed therein proximate said upper end;

an upper bracket attached to said vertical support member proximate the upper end of said vertical support member;

a lower bracket attached to said vertical support member spaced from said upper bracket;

a first support structure having a first end and a second end, said first end being pivotally attached to said upper bracket, said first support structure having a left arm and a right arm spaced from said left arm which are configured to be triangular in projection with an apex end as said first end;

a second support structure having a first end and a second end, said first end being pivotally attached to said vertical support member spaced from said first end of said first support structure, said second support structure has a left arm and a right arm spaced from said left arm which are configured to be triangular in projection with an apex end as said first end;

a backboard having a front and a back, said second end of said first support structure and said second end of said second support structure each being rotatably attached to said back;

a basketball hoop mounted to said front of said backboard;

a fulcrum attached proximate said upper end of said vertical support member to be positioned between said backboard and said vertical support member;

a lever member having a first end and a second end with a fulcrum point thereinbetween, said fulcrum point being positionable proximate said fulcrum, said lever member having a first lever portion extending from said first end to said fulcrum and a second lever portion extending from said fulcrum to said second end, said second lever portion extending into said aperture of said vertical support member;

an actuator positioned within said hollow portion of said vertical support member, said actuator having a lower end and an upper end, said upper end being connected to said second lever portion, and said actuator being configured to move said second portion of said lever member about said fulcrum and in turn cause said first portion of said lever member to urge said backboard to move between a first position and a second position vertically displaced from said first position;

a cross member extending between said left arm and said right arm of one of said first support member and said second support member, said first end of said lever being attached to said cross member, and one of said cross member and said first end being rotatably attached for movement of said lever member relative to said fulcrum; and an operating structure attached to said vertical support member and positioned for operation by a user, said lower end of said actuator being connected to said operating structure and said operating structure being configured to cause said upper end of said actuator to move said second portion of said lever member upon operation of said operating structure by a user.

* * * * *